US010789932B2

(12) United States Patent
Zollner et al.

(10) Patent No.: US 10,789,932 B2
(45) Date of Patent: Sep. 29, 2020

(54) NOISE CONTROL

(71) Applicant: Harman Becker Automotive Systems GmbH, Karlsbad (DE)

(72) Inventors: Juergen Zollner, Straubing (DE); Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/341,111

(22) PCT Filed: Oct. 20, 2016

(86) PCT No.: PCT/IB2016/056305
§ 371 (c)(1),
(2) Date: Apr. 11, 2019

(87) PCT Pub. No.: WO2018/073626
PCT Pub. Date: Apr. 26, 2018

(65) Prior Publication Data
US 2020/0043461 A1 Feb. 6, 2020

(51) Int. Cl.
*G10K 11/178* (2006.01)

(52) U.S. Cl.
CPC .. *G10K 11/17854* (2018.01); *G10K 11/17879* (2018.01); *G10K 11/178* (2013.01); *G10K 2210/1282* (2013.01); *G10K 2210/3022* (2013.01); *G10K 2210/3028* (2013.01)

(58) Field of Classification Search
CPC ..... G10K 11/17854; G10K 11/17879; G10K 2210/3022; G10K 2210/3028; G10K 2210/1281; G10K 2210/1282
USPC ..... 381/71.1, 71.14
See application file for complete search history.

(56) References Cited

U.S. PATENT DOCUMENTS 5,222,148 A * 6/1993 Yuan ..... F01N 1/065 381/71.9
5,586,190 A 12/1996 Trantow et al.
8,306,240 B2 * 11/2012 Pan ..... G10K 11/178 381/94.1

(Continued)

FOREIGN PATENT DOCUMENTS

EP 3182407 A1 6/2017

OTHER PUBLICATIONS

International Search Report dated Jul. 5, 2017, PCT/IB2016/056305 filed Oct. 20, 2016, 17 pgs.

(Continued)

*Primary Examiner* — Disler Paul
(74) *Attorney, Agent, or Firm* — Brooks Kushman P.C.

(57) ABSTRACT

An example active noise control filtering with an adaptive filter structure includes a controllable filter matrix with reference and error input signals, and updating the filter coefficients dependent on an optional filtered reference signal and an error signal, the error signal being representative of a performance criterion of the filter module. Further, a leakage functionality and a convergence functionality is applied to the updated filter coefficients. The leakage functionality is controlled by at least one of a flush functionality, freeze functionality, spatial freeze functionality and leakage threshold, and the convergence functionality is controlled by the freeze functionality and spatial freeze functionality.

17 Claims, 7 Drawing Sheets

(56) References Cited

U.S. PATENT DOCUMENTS

| | | | | |
|---|---|---|---|---|
| 8,355,512 | B2 * | 1/2013 | Pan | G10K 11/178 381/71.11 |
| 9,607,602 | B2 * | 3/2017 | Po | G10K 11/175 |
| 9,629,344 | B2 * | 4/2017 | Edwards | A01K 63/006 |
| 9,729,966 | B2 * | 8/2017 | Pan | G10K 11/178 |
| 2010/0014685 | A1 | 1/2010 | Wurm | |
| 2010/0098263 | A1 * | 4/2010 | Pan | G10K 11/178 381/71.11 |
| 2012/0140943 | A1 | 6/2012 | Hendrix et al. | |
| 2015/0063581 | A1 * | 3/2015 | Tani | G10K 11/178 381/71.2 |
| 2015/0071453 | A1 | 3/2015 | Po et al. | |
| 2015/0356965 | A1 * | 12/2015 | Tani | G10K 11/175 381/71.4 |
| 2019/0272814 | A1 * | 9/2019 | Park | G10K 11/002 |

OTHER PUBLICATIONS

Kim, Benjamin J. et al., "Linear independence method for system identification/secondary path modeling for active control", The Journal of Acoustical Society of America, American Institute of Physics for the Acoustical Society of America, Jan. 1, 2005, pp. 1452-1468, vol. 118, No. 3, New York, NY, US.

Office Action dated Aug. 20, 2020 for European Application No. 16791100.7 filed Mar. 27, 2019, 8 pgs.

* cited by examiner

NOISE CONTROL

CROSS-REFERENCE TO RELATED APPLICATION

This application is the U.S. national phase of PCT Application No. PCT/IB2016/056305 filed on Oct. 20, 2016, the disclosure of which is incorporated in its entirety by reference herein.

BACKGROUND

1. Technical Field

The disclosure relates to a system and method (generally referred to as a "system") for controlling noise, for example, road noise.

2. Related Art

Sound is a pressure wave which consists of alternating periods of compression and expansion. For noise-cancellation a sound wave is emitted with the same amplitude but with inverted phase (also known as antiphase) to the original sound. The waves combine to form a new wave, in a process called interference, and effectively cancel each other out—an effect which is called destructive interference. Modern active noise control (ANC) is commonly achieved through the use of analog and/or digital signal processing. Adaptive algorithms can be designed to analyze the waveform of the background aural or non-aural noise, and, based on the specific algorithm, can generate a signal that will either phase shift or invert the polarity of the original signal. This inverted signal (antiphase signal) is then amplified and a transducer creates a sound wave directly proportional to the amplitude of the original waveform, creating destructive interference. This effectively reduces the loudness of the perceivable noise.

A noise-cancellation transducer may be co-located with the sound source to be attenuated. In this case it should have the same audio power level as the source of the unwanted sound. Alternatively, the transducer emitting the cancellation signal may be located at the location where sound attenuation is wanted (e.g. a user's ear). This requires a much lower power level for cancellation but is effective only for a single user. Noise cancellation at other locations is more difficult as the three-dimensional wave fronts of the unwanted sound and the cancellation signal could match and create alternating zones of constructive and destructive interference, reducing noise in some spots while increasing noise in others. In small enclosed spaces (e.g. the passenger compartment of a vehicle) global noise reduction can be achieved via multiple speakers and error microphones, and through measurement of the modal responses of the enclosure.

Land based vehicles, when driven upon roads and other surfaces, generate low frequency noise known as road noise. As the wheels are driven over the road surface, the road noise is at least in part structure borne, i.e., it is transmitted through vehicle components such as tires, wheels, hubs, chassis components, suspension components such as suspension control arms or wishbones, dampers, anti-roll or sway bars and the vehicle body, and can be heard in the vehicle cabin. In order to reduce the vibrations in the vehicle components and hence road noise experienced by cabin occupants, ANC systems of the kind described above may be employed.

A widely used adaption algorithm with ANC systems is the Normalized Filtered X Least Mean Square (NFX-LMS) algorithm, which is used because of its known advantage of speedy convergence and therefore quick adaption to new boundary conditions. To achieve additional speed in the convergence, the goal of the algorithm may be defined so as to increase its step-size to the biggest values possible, thereby running the risk of creating an instable system. Selecting a static step-size will always be a trade-off between speed and stability. As a consequence there is a demand for new techniques allowing accelerated normalized convergence without compromising on stability. It is desirable to achieve a fast but robust ANC system e.g. for Road Noise Cancellation (RNC), without compromising performance and without taking additional risks involving instability.

SUMMARY

An example active noise control filter arrangement with an adaptive filter structure includes a controllable filter module configured to process, according to a controllable K×M filter matrix with K≥1 and M≥1, K input signals to provide M output signals, the K×M filter matrix having variable filter coefficients and being controlled by updating the filter coefficients. The filter arrangement further includes a filter control module configured to update the filter coefficients dependent on the K input signals and L≥1 error signals, the L error signals being representative of at least one performance criterion of the filter module. The filter arrangement further includes an update control module configured to apply a leakage functionality and a convergence functionality to the updated filter coefficients. At least one of the following applies: The leakage functionality is controlled by at least one of a flush functionality, freeze functionality, spatial freeze functionality and leakage threshold, and the convergence functionality is controlled by at least one of freeze functionality and spatial freeze functionality.

An example active noise control filtering method using an adaptive filter structure includes processing, according to a controllable K×M filter matrix with K≥1 and M≥1, K input signals to provide M output signals, the K×M filter matrix having variable filter coefficients and being controlled by updating the filter coefficients. The method further includes updating the filter coefficients dependent on the K input signals and L≥1 error signals, the L error signals being representative of at least one performance criterion of the filter module. The method further includes applying a leakage functionality and a convergence functionality to the updated filter coefficients. At least one of the following applies: The leakage functionality is controlled by at least one of a flush functionality, freeze functionality, spatial freeze functionality and leakage threshold, and the convergence functionality is controlled by at least one of freeze functionality and spatial freeze functionality.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
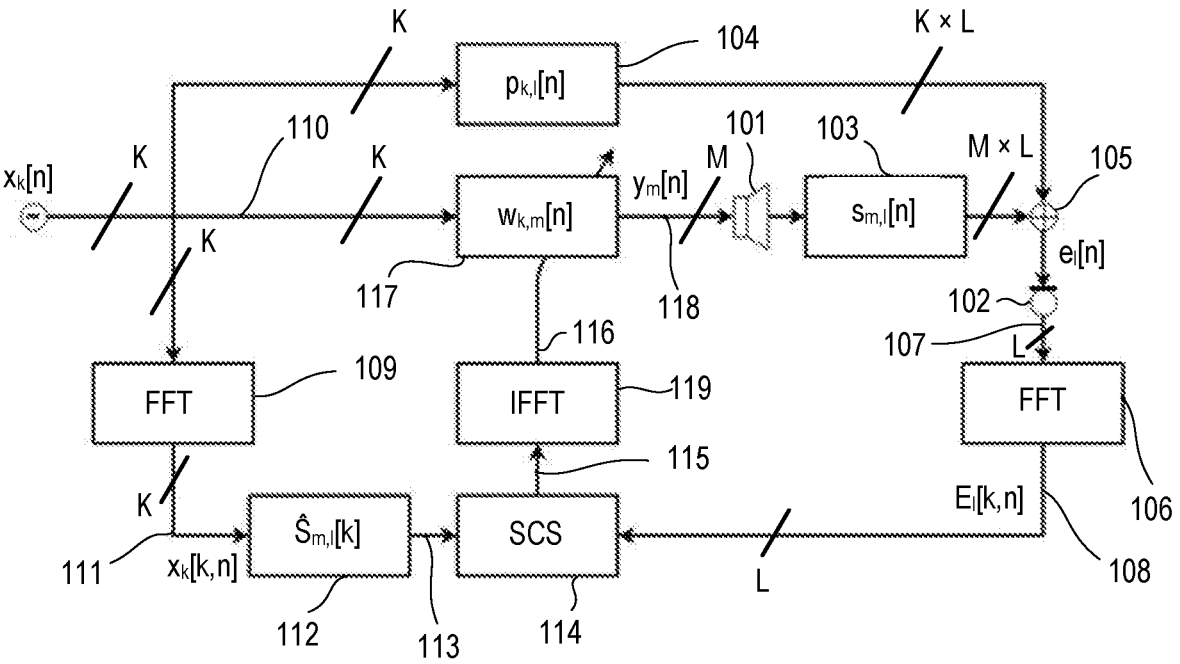
FIG. 1 is a signal flow chart illustrating an exemplary multi-channel active noise control structure.

Referring to FIG. 1, an exemplary ANC multichannel system may include a multiplicity of loudspeakers 101 as actuators that convert electrical signals into sound waves and a multiplicity of error microphones 102 as sensors that convert sound waves into electrical signals. Secondary paths 103 transfer acoustic waves from the loudspeakers 101 to the error microphones 102 which also receive via primary paths 104 disturbing sound waves originating from a noise signal source (not shown). The sound waves transferred by the primary paths with primary path transfer functions and the secondary paths with secondary path transfer functions interfere with each other, which can be described by summation operations 105. A fast Fourier transform (FFT) module 106 is connected downstream of the error microphones 102 and transforms error microphone signals 107 in the time domain to error microphone signals 108 in the frequency domain. A further FFT module 109 transforms reference signals 110 in the time domain (also referred to as filter input signals) into reference signals 111 in the frequency domain.

The reference signals 110 are representative of the disturbing sound waves. The reference signals 111 in the frequency domain are (optionally) filtered with a filter module 112 with transfer functions that model the secondary path transfer functions to provide filtered reference signals 113 (also referred to as filtered input signals) in the frequency domain. The filtered reference signals 113 in the frequency domain and the error (microphone) signals 108 in the frequency domain (the error signals represent performance criterions of the system, e.g., the cancellation performance) are supplied to a control module 114 which generates control signals 115 in the frequency domain. The control signals 115 in the frequency domain are transformed by an inverse fast Fourier transform (IFFT) module 119 into control signals 116 in the time domain which are used to update a controllable filter module 117 (also referred to as w-filter) connected upstream of the loudspeaker 101 to supply loudspeaker signals 118 (also referred to as a filter output signals) thereto and supplied with the reference signals 110. The controllable filter module 117 provides, for example, a controllable w-filter matrix (with controllable w-filter transfer functions). Although no distinction is made in FIG. 1 between acoustic domain and electric domain, all modules and operations are in the electrical domain except the primary path 104, the secondary path 103 and the acoustic interference represented by summer 105 which are in the acoustic domain. Loudspeakers 101 and error microphones 102 can be seen as converters from the electrical domain into the acoustic domain and vice versa.

The exemplary ANC multichannel system shown in FIG. 1 has a structure in which the forward path (e.g., controllable filter module 117) operates in the time domain and the update part (e.g., control module 114) operates in the frequency domain. In the following description, [n] is the nth sample in the time domain, [k] is the kth bin in the frequency domain, K≥1 is the number of reference signals, M≥1 is the number of loudspeakers employed, and L≥1 is the number of error microphones employed. Further, $x_k[n]$ with k=1 . . . K describes the reference signals 110 in the time domain, $X_k[k,n]$ with k=1 . . . K describes the reference signals 111 in the frequency domain, $e_l[n]$ with l=1 . . . L describes the error microphone signals 107 in the time domain, $E_l[k,n]$ with l=1 . . . L describes the error microphone signals 108 in the frequency domain, and $y_m[n]$ with m=1 . . . M describes the loudspeaker signals 118 in the time domain. Still further, $w_{k,m}[n]$ with k=1 . . . K and m=1 . . . M is a (K×M) matrix of FIR filters in the time domain, $p_{k,l}[n]$ with k=1 . . . K and l=1 . . . L is a (K×L) matrix of transfer functions representing the primary paths in the time domain, $s_{m,l}[n]$ with m=1 . . . M and l=1 . . . L stands for a (M×L) matrix of transfer functions representing the secondary paths in the time domain. $\hat{S}_{m,l}[k]$ with m=1 . . . M and l=1 . . . L is a (M×L) stands for a matrix of estimations of the secondary paths in the frequency domain.

The primary and secondary paths may have a spectral behavior that changes over time. For example, the secondary paths may be modified whenever something is impacting or changing the acoustic chamber geometry. Thus the primary and secondary paths can also be described as $P_{k,l}[n]$ with k=1 . . . K and l=1 . . . L, which is a (K×L) matrix of transfer functions representing the time dependent primary paths in the frequency domain, and $S_{m,l}[k, n]$ with m=1 . . . M and l=1 . . . L, which is a (M×L) matrix of transfer functions representing the time dependent secondary paths in the frequency domain. The measured secondary paths are only "snapshots" of a given set-up so that they are treated as estimations representing a significant contribution to the adaptation process. The contribution to the adaptation process can be described by the "Summed-Cross-Spectrum". The "Summed-Cross-Spectrum" $SCS_{k,m}[k,n]$ for each m and k combination may be as follows:

$$SCS_{k,m}[k] = \underline{S}ummed\underline{C}ross\underline{S}pectrum_{k,m}[k, n] = \sum_{l=1}^{L} conj\left(X_k[k, n]\hat{S}_{m,l}[k]\right)E_l[k, n]$$

Taking this into account, the w-filter matrix update (coefficients $w_{k,m}[n]$, and updated coefficients $w_{k,m}[n+1]$) can be described as below:

$$w_{k,m}[n+1] = w_{k,m}[n] - \mu_{global}\ IFFT\{SCS_{k,m}[k,n]\}$$
$$= w_{k,m}[n] - IFFT\{\mu_{global}\ SCS_{k,m}[k,n]\}$$
$$Convergence_{k,m}[k,n] = \mu_{global} SCS_{k,m}[k,n]$$
$$w_{k,m}[n+1] = w_{k,m}[n] - IFFT\{Convergence_{k,m}[k,n]\}$$
$$= w_{k,m}[n] - IFFT\{C_{k,m}[k,n]\}$$

in which $\mu_{global}$ is the global defined adaptation step size ($\mu$) and $C_{k,m}$[k,n] with k=1 . . . K and m=1 . . . M is a (K×M) matrix of time dependent convergence values (also referred to as $Convergence_{k,m}$[k,n]) in the frequency domain.

The update is performed, in this example, according to a Filtered X Least Mean Square (FX-LMS) algorithm, in which X represents an input signal (e.g., one of the reference signals 111) filter update routine. However, any other appropriate algorithm may be used as well. The stability of the FX-LMS algorithm is highly dependent on the secondary path estimation accuracy and level of disturbance within the reference signals. The baseline (or background) may additionally include reference signal normalization, e.g., by way of an NFX-LMS algorithm. One normalization option is:

$$NC_{k,m}[k,n] = \underline{N}ormalized\underline{C}onvergence_{k,m}[k,n] = \frac{C_{k,m}[k,n]}{\sqrt{X_k[k,n]\,conj(X_k[k,n])}}$$

So the w-Filter matrix update can be rewritten as:

$$w_{k,m}[n+1]=w_{k,m}[n]-\mathrm{IFFT}\{\{NC_{k,m}[k]\}\}$$

in which $NC_{k,m}$[k,n] with k=1 . . . K and m=1 . . . M is a (K×M) matrix of normalized and time dependent convergence values in the frequency domain.

The system described below will not distinguish between different Normalized Filtered X Least Mean Square (NFX-LMS) variants. It is further assumed that the previously proposed normalization is used. The normalization applies a reciprocal, frequency dependent scaling to the summed cross spectrum by the energy of the reference signal. Hence the convergence step size automatically adjusts to the reference signal's spectral energy, leading to an adaptation rate which will be as fast as possible, independent from the spectral energy content of the reference signals.

Reference signal normalization does, by no means, eliminate the need of introducing a reference signal threshold definition to control the update process, known as Modified Filtered X Least Mean Square (MFX-LMS) algorithm. Nevertheless, the introduced system can further be enhanced by including such an algorithm. Although the normalization already improves ANC systems, additional techniques may be applied to further enhance stability and/or performance.

For example, the baseline assumes predefined, frequency dependent step size ($\mu$) values which may be defined as:

$$TNC_{k,m}[k,n] = \underline{T}uned\underline{N}ormalized\underline{C}onvergence_{k,m}[k,n] = \frac{\mu_{k,m}[k]\,SCS_{k,m}[k,n]}{\sqrt{X_k[k,n]\,conj(X_k[k,n])}}$$

Here the w-filter update process can be rewritten as:

$$w_{k,m}[n+1] = w_{k,m}[n] - IFFT\left\{\frac{\mu_{k,m}[k]\,SCS_{k,m}[k,n]}{\sqrt{X_k[k,n]\,conj(X_k[k,n])}}\right\} = w_{k,m}[n] - IFFT\{TNC_{k,m}[k,n]\}$$

in which $\mu_{k,m}$[k] with k=1 . . . K and m=1 . . . M is a (K×M) matrix of individually tuned, frequency dependent, adaptation step sizes, and $TNC_{k,m}$[k,n] with k=1 . . . K and m=1 . . . M is a (K×M) matrix of the tuned, normalized and time dependent convergence in the frequency domain. Different kinds of convergence methods, e.g., represented by the above-mentioned update terms such as convergence $C_{k,m}$[k,n], normalized convergence $NC_{k,m}$[k,n] and tuned normalized convergence $TNC_{k,m}$[k,n], shall be consolidated into the term "Scaled Spectral Mean-Square-Error (MSE) Gradient ($\nabla J_{k,m}$[k, n])".

$$\text{Scaled Spectral Mean – Square – Error Gradient} = \nabla J_{k,m}[k,n] == \begin{cases} C_{k,m}[k,n], \text{ in case of no normalization and global } \mu \\ NC_{k,m}[k,n], \text{ in case of normalization and global } \mu \\ TNC_{k,m}[k,n], \text{ in case of normalization and tunable} \\ \mu_{k,m}[k] \text{ including all other variations} \end{cases}$$

It is noted that independent of the applied convergence method further such methods can be applied without any restrictions. Therefore, the w-filter update process can be rewritten as:

$$w_{k,m}[n+1]=w_{k,m}[n]-\mathrm{FFT}\{\nabla J_{k,m}[k,n]\}$$

This implies that each convergence method can be substituted by another method without affecting the proposed improvements.

Figure 2:
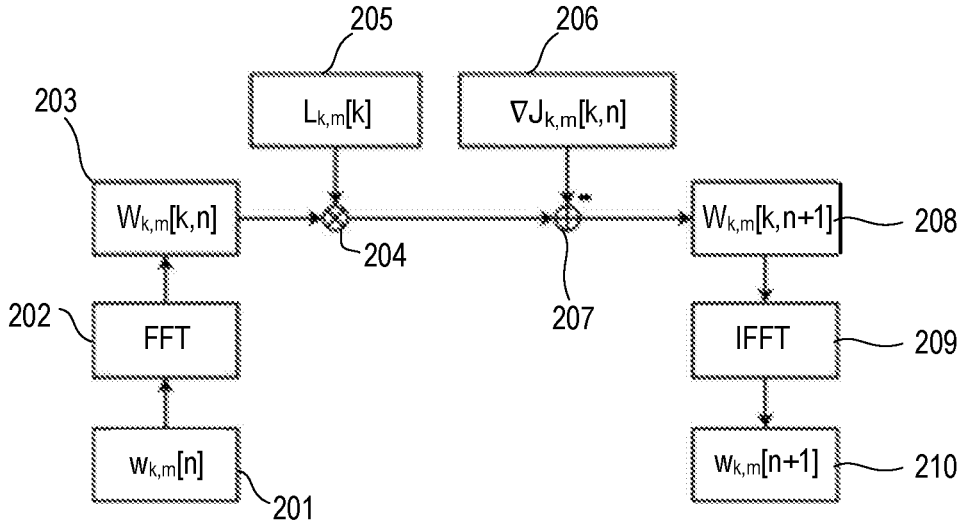
FIG. 2 is a signal flow chart illustrating the application of a leakage factor and an update term in the structure shown in FIG. 1.

As can be seen, in this example the step-sizes are shaped over all frequency bins for each w-filter matrix index 'm' and 'k', which represent one step size tuning set. Additionally, the baseline assumes a leakage factor that is already introduced within the w-filter update process along with the above described normalized convergence step-size, as shown in FIG. 2, which illustrates the introduction of a leakage factor within the w-filter update, applied in the frequency domain. In adaptive filtering, leakage is a stabilization process which may be applied if the covariance matrix is close to singular (i.e. at least one of the eigenvalues is very small), or if there are finite-precision effects in the implementation of the adaptive filter. Leakage may change the update formula such that not only the mean squared error but also the norm of the filter taps is minimized. This prevents unbounded growth of the filter coefficients in cases of numerical ill-conditioning.

FIG. 2 shows a signal flow structure with a frequency dependent leakage factor matrix of size K×M within the w-filter matrix update applied in the frequency domain and in connection with a Finite Impulse Response (FIR) filter. A non-updated (K×M) matrix 201 of w FIR filter taps is received and converted from the time domain into the frequency domain by way of a FFT operation 202 to provide a non-updated (K×M) matrix 203 in the frequency domain. The non-updated (K×M) matrix 203 in the frequency domain is multiplied in multiplication operation 204 with a corresponding leakage factor 205. From the result of this multiplication operation 204, a matrix 206 of update terms in the frequency domain is subtracted in a subtraction operation 207. The result of this subtraction operation 207 is representative of the updated (K×M) matrix 208 of w FIR filter taps in the frequency domain. The updated (K×M) matrix 208 of w FIR filter taps is converted from the frequency domain into the time domain by way of a IFFT operation 209 to output an updated (K×M) matrix 210 of w FIR filter taps in the time domain.

In the flow chart shown in FIG. 2, n stands for the $n^{th}$ sample in the time domain, k stands for the $k^{th}$ bin in the frequency domain, K is the number of reference signals, and M is the number of loudspeakers. Furthermore, $w_{k,m}[n]$ with k=1 . . . K and m=1 . . . M stands for the non-updated (K×M) matrix 201 of w FIR filter taps in the time domain, $W_{k,m}[k,n]$ with k=1 . . . K and m=1 . . . M stands for the non-updated (K×M) matrix 203 of w FIR filters taps in the frequency domain, $w_{k,m}[n+1]$ with k=1 . . . K and m=1 . . . M, stands for the updated (K×M) matrix 210 of w FIR filters taps in the time domain, and $W_{,k,m}[k,n+1]$, with k=1 . . . K and m=1 . . . M, stands for the updated (K×M) matrix 208 of W FIR filters taps in the frequency domain The leakage value (in the following also referred to as $L_{k,m}[k]$) can be regarded as the w-filter's "oblivion" factor, with which the currently adapted w-filter coefficient values will be "forgotten", i.e. slowly driven to zero. The value may be tunable over frequency for each individual w-filter matrix element. If the leakage shall be used as an individual multiplication factor, the w-filter update may be performed in the frequency domain in order to avoid an otherwise required, complicated convolution.

Thus the w-filter matrix update can be described as follows:

$$w_{k,m}[n+1] = IFFT\{W_{k,m}[k,n]\ Leakage_{k,m}[k] - \nabla J_{k,m}[k,n]\} = IFFT\{W_{k,m}[k,n]L_{k,m}[k] - \nabla J_{k,m}[k,n]\}$$

in which $$W_{k,m}[k,n]=\mathrm{FFT}\{w_{k,m}[n]\}$$

$$W_{k,m}[k,n+1]=\mathrm{FFT}\{w_{k,m}[n+1]\}$$

$$L_{k,m}[k]=\underline{L}\mathrm{eakage}_{k,m}[k]$$

However, by definition, introduction of a leakage factor reduces the system performance because leakage and the update term act against each other. Therefore, in the following, leakage is only used as an instrument for protection against instability due to changes in the secondary paths. Furthermore, basic control features which provide control over the w-filter update via leakage and the update term are introduced. The basic control features allow for enhancing the flush mechanism, freeze mechanism, spatial freeze mechanism, and leakage threshold. Those basic control features further stabilize the system without requiring additional memory and central processing module (CPU) capacity. Introduction of basic control features within the w-filter update process in the frequency domain may be performed, for example, with basic logic modules that control the update process as shown in FIGS. 3-6. The components for flush control, freeze control, spatial freeze control and leakage threshold may be used as a complete set, a subset or as individual modules (modules) wherein a module or module can be hardware, software or a combination thereof.

Figure 3:
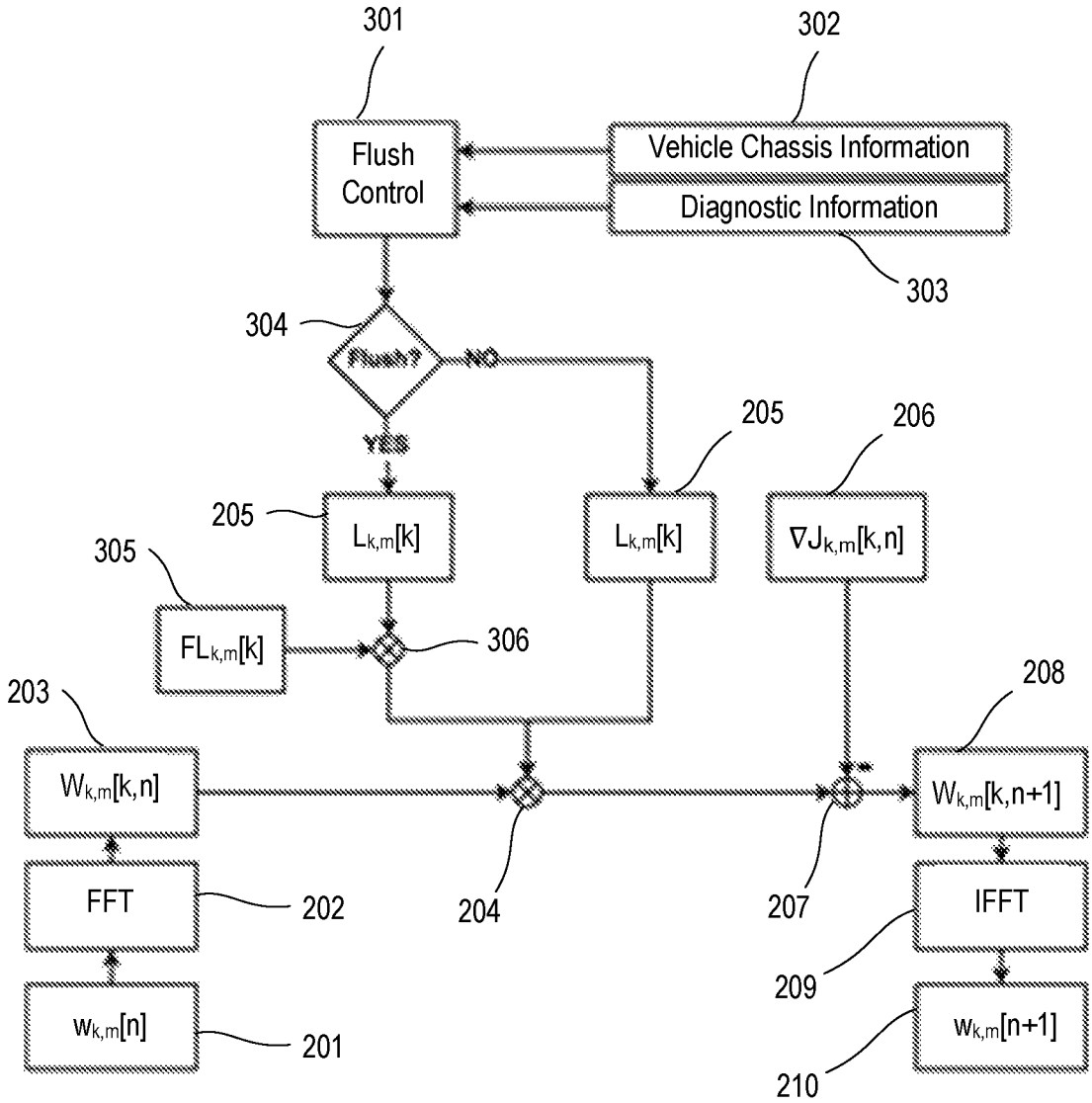
FIG. 3 is a signal flow chart illustrating a flush functionality used as an individual basic control feature for manipulating leakage in the structure shown in FIG. 2.

Referring to FIG. 3, the signal flow structure shown in FIG. 2 may be altered so that the leakage functionality 205 includes a flush functionality as a basic control feature for the w-filter update process. A flush control module 301 receives, for example, vehicle/chassis information 302 and diagnostic information 303 from appropriate sensors (not shown) and/or in-car controllers (not shown). The flush control module 301 provides a flush request signal to a detection module 304. If no flush request is detected by the detection module 304, the leakage factor 205, i.e., $L_{k,m}[k]$, is used in the multiplication operation 204. If, however, a flush request is detected by the detection module 304, the leakage factor 205 which is $L_{k,m}[k]$, is multiplied (e.g., by way of a multiplier 306) with a flush leakage matrix 305, i.e., $FL_{k,m}[k]$, and the product of the two is used in the multiplication operation 204. The flush control module 301 immediately flushes (to zero) or ramps down all and/or parts of the w-filter coefficients. This is achieved by temporarily multiplying the regularly used leakage values by zero or small constants defined within the flush leakage matrix $FL_{k,m}[k]$, wherein k=1 . . . K and m=1 . . . M matrix of flush leakage values in the frequency domain:

$$w_{k,m}[n+1] = \begin{cases} IFFT\{W_{k,m}[k,n]L_{k,m}[k] - \nabla J_{k,m}[k]\}, & \text{if flush} \neq \text{TRUE} \\ IFFT\{W_{k,m}[k,n]L_{k,m}[k]FL_{k,m}[k] - \nabla J_{k,m}[k]\}, & \text{if flush} = \text{TRUE} \end{cases}$$

in which $$FL_{k,m}[k]=\underline{F}\mathrm{lush}\underline{L}\mathrm{eakage}_{k,m}[k].$$

It is assumed that the update term contribution is weak compared to the leakage factor weighted by the flush effect and therefore the w-filter coefficients start to fade out.

Figure 4:
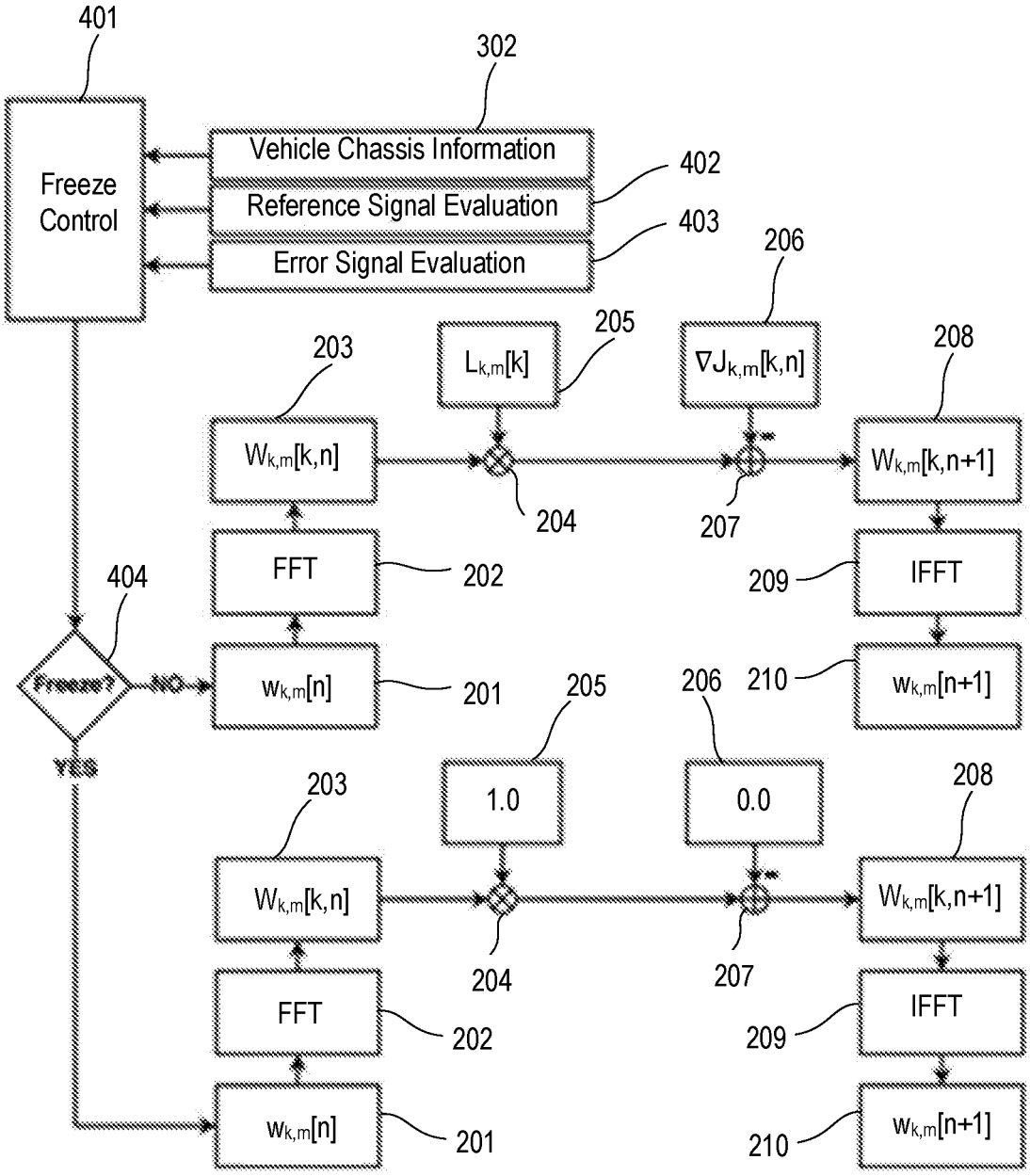
FIG. 4 is a signal flow chart illustrating a freeze functionality used as an individual basic control feature for manipulating leakage and the update term in the structure shown in FIG. 2.

Referring to FIG. 4, the signal flow structure shown in FIG. 2 may be altered so that the leakage functionality 205 includes a freeze functionality as a basic control feature for the w-filter update process. A freeze control module 401 receives, for example, vehicle/chassis information 302, reference signal evaluation information 402 and error signal evaluation information 403 from appropriate sensors (not shown), error microphones (not shown) and/or in-car controllers (not shown). The freeze control module 401 provides a freeze request signal to a detection module 404. If no freeze request is detected by the detection module 404, the leakage factor 205 is frequency dependent, i.e., $L_{k,m}[k]$ and the update term 206 i.e., $\nabla J_{k,m}[k,n]$, is also frequency dependent. If, however, a freeze request is detected by the detection module 404, the leakage factor 205 is set to 1 and the update term 206 is set to 0.

The freeze control module 401 is implemented to immediately freeze the current adaption process by bypassing the leakage factor (205) and to zero the matrix of update terms 206 in the frequency domain:

$$w_{k,m}[n+1] = \begin{cases} IFFT\{W_{k,m}[k,n]L_{k,m}[k] - C_{k,m}[k,n]\}, & \text{if freeze} \neq \text{TRUE} \\ IFFT\{W_{k,m}[k,n] - 0\}, & \text{if freeze} = \text{TRUE} \end{cases}$$

Figure 5:
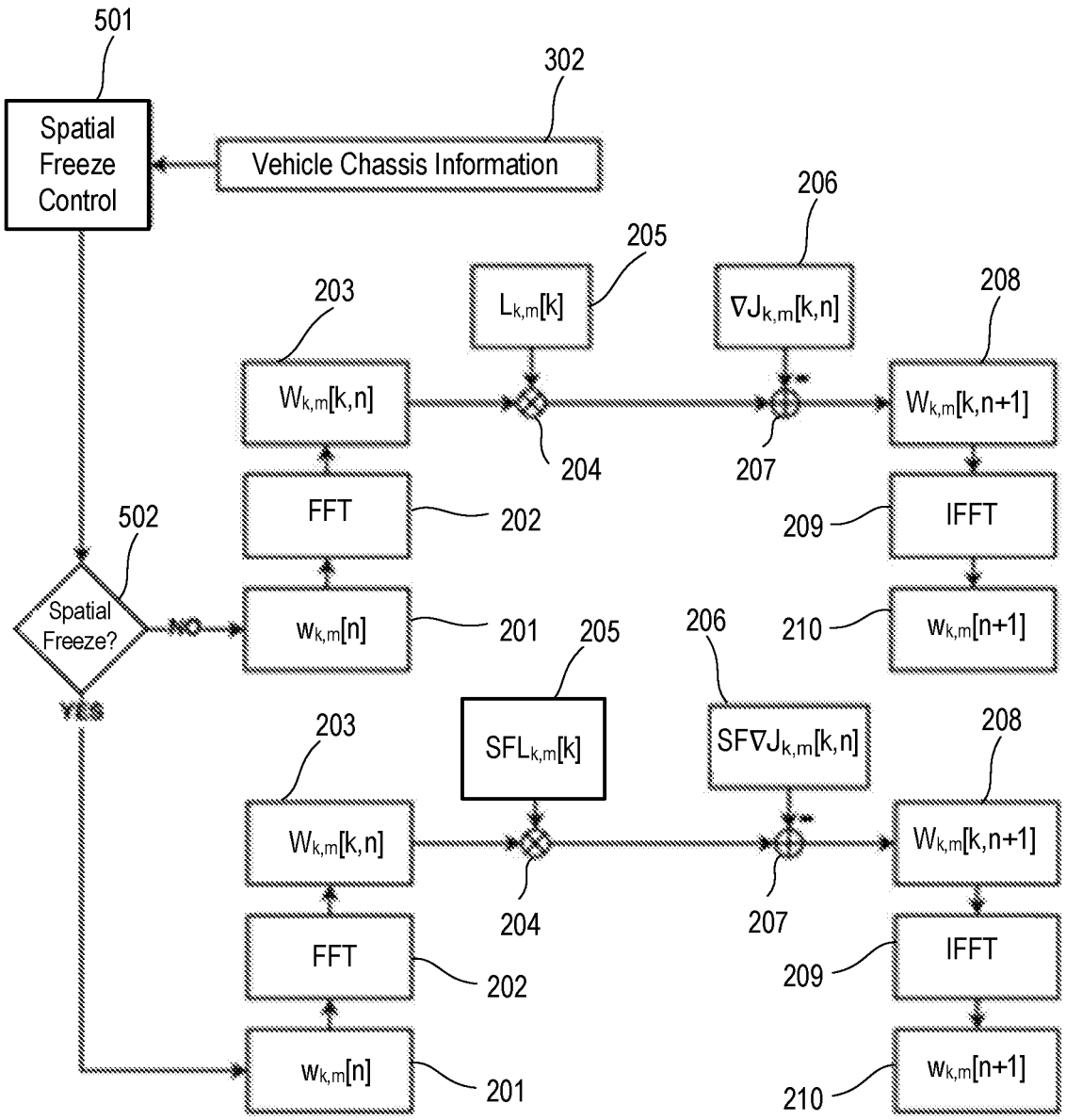
FIG. 5 is a signal flow chart illustrating a spatial freeze functionality used as an individual basic control feature for manipulating leakage and the update term in the structure shown in FIG. 2.

Referring to FIG. 5, the signal flow structure shown in FIG. 2 may be altered so that the leakage functionality 205 includes a spatial freeze functionality as a basic control feature for the w-filter update process. A spatial freeze control module 501 receives, for example, vehicle/chassis information 302 from appropriate sensors (not shown in FIG. 5, see FIG. 3) and/or in-car controllers (not shown). The spatial freeze control module 501 provides a spatial freeze request signal to a detection module 502. If no spatial freeze request is detected by the detection module 502, the leakage factor 205 is calculated in the frequency domain, i.e., $L_{k,m}[k]$ and the update term 206 is calculated in the frequency domain, i.e., $\nabla J_{k,m}[k,n]$. If, however, a spatial freeze request is detected by the detection module 502, the leakage factor 205 is set to a matrix $SFL_{k,m}[k]$, k=1 . . . K and m=1 . . . M, which represents spatial freeze leakage values in the frequency domain, and the update term 206 is set to a matrix $SF\nabla J_{k,m}[k,n]$, k=1 . . . K and m=1 . . . M, which represents frequency dependent spatial freeze update term in the frequency domain. Please note that [k] represents spectral bins (in the frequency domain), n represents a discrete time (in the time domain), and [k,n] represents a spectral behavior that may change over time.

The update process may be disabled by the freeze mechanism. The spatial freeze module 501 may toggle a spatial freeze flag and change the adaption process as follows:

$$w_{k,m}[n+1] = \begin{cases} IFFT\{W_{k,m}[k,n]L_{k,m}[k] - \nabla J_{k,m}[k,n]\}, & \text{if spatial freeze} \neq \text{TRUE} \\ IFFT\{W_{k,m}[k,n]SFL_{k,m}[k] - SF\nabla J_{k,m}[k,n]\}, & \text{if spatial freeze} = \text{TRUE.} \end{cases}$$

in which $SFL_{k,m}[k]$ with k=1 . . . K and m=1 . . . M is a matrix of spatial freeze leakage values in the frequency domain, and $SF\nabla J_{k,m}[k, n]$ with k=1 . . . K and m=1 . . . M is a matrix of spatial freeze update terms that are time dependent in the frequency domain.

Protection is achieved by the spatial freeze module 501 as it temporary limits the bandwidth of both the leakage and the update term in the frequency domain. Once the spatial freeze applies, only the upper frequency bins of the update term and the leakage are frozen, while the lower frequency bins stay as tuned:

$$SF\nabla J_{k,m}[k] = \begin{cases} C\nabla J_{k,m}[k,n], & \text{if } k \leq SF_{Bin} \\ 0, & \text{if } k > SF_{Bin} \end{cases}$$

$$SFL_{k,m}[k] = \begin{cases} L_{k,m}[k], & \text{if } k \leq SF_{Bin} \\ 1, & \text{if } k > SF_{Bin} \end{cases}$$

in which $SF_{Bin}$ is the spatial freeze limit/boundary bin. This method need not be limited to a sharp transmission between non spatial frozen and spatial frozen values, also variations of smooth transmissions techniques may be applied.

Vehicle information such as vehicle chassis information 302 and/or reference signal evaluation information such as reference signal evaluation information 402 is used to provide feedback to the flush control module 301, freeze control module 401 and/or spatial freeze control module 501. The vehicle information and/or reference signal evaluation information may execute common debounce algorithms, e.g., including hysteresis techniques, in order to avoid unwanted on/off feedback behavior to consecutive modules.

The flush control module 301 provides a flush detection that may be triggered, for example, by the reference signal and/or a vehicle information in case an already adapted w-filter has an invalid w-filter matrix and may cause hearable artifacts, because the primary path is expected to be permanently changing or one or more system components (e.g. sensors or loudspeakers) are detected as permanently being offline. Here the regular adaption process of applying the update term 206 and leakage factor 205 is insufficient or slow. Therefore, in order to ensure a safe re-adaption of the w-filter within a given new situation to an optimal w-filter setup, the w-filters become partly or completely flushed within a defined fading time.

The flush mechanism may be suitable in special scenarios in which a permanent significant and rapid change of the road noise and/or primary path is expected such as, for example, when using retractable tire studs, changing tires (summer to winter and vice versa), modifying suspension or acoustically relevant chassis components, applying dynamic driving modes as (e.g., sport and comfort mode), and in off-road suspension stiffness setups, and car-lift setups.

Also, if one or more peripheral sub-systems permanently fail, the remaining system may continue successfully with normal operation after a complete flush and re-adaptation. The vehicle on-board or on-system diagnostic may detect such permanent failures. According to a decision matrix it may be evaluated whether an operation on the remaining system can successfully continue. The term successfully is understood herein to mean that a sufficient attenuation is expected based on real measurements or simulations of such scenarios. For example, sub-systems such as error microphones, accelerometers and loudspeakers may fail.

Freeze trigger evaluation may be used to trigger the freeze module in order to prevent the already adapted system from becoming instable and/or losing performance as the w-filter coefficients could adapt to an un-desired target during ramp-up. It is assumed that the freeze control module 401 will be active only temporally, for example, in case of non-road related disturbances, high reference signal impacts, and/or low reference signal levels.

Regarding the non-road related disturbances, the impact of wind noise, for example, increases with increasing vehicle speed and at a certain level the wind noise drowns out the internal cabin noise. In such a scenario, further w-filter adaptation may be disabled by defining a maximum vehicle speed threshold to trigger the freeze mechanism. Non-road related disturbances may include at least one of wind noise, fan noise (e.g. air conditioning or other compressor modules using ventilators), audio signals from infotainment and/or entertainment systems, passenger speech and other vehicle interior disturbances.

Regarding the high reference signal impacts, adequate evaluation of the reference signal (e.g., reference signal and/or a vehicle information evaluation 303) may detect roads with too many excessively high impacts. In order to protect the adaption process to a high number of such unusual broadband impacts and an absence of stationary ones, the freeze mechanism may be triggered. Vehicle off-road information may also be used to enhance the detection process.

Regarding the low reference signal levels, another suitable scenario for freezing the adaptation entails defining a lower threshold limit for the reference signal level, so that the freeze control module 401 is triggered if the reference signal level is below a minimum value. For example, one of the two ways described below may be advantageous over simply detecting an excessively low reference signal level. One is to permanently evaluate the reference signal and to trigger the freeze control module 401 once the signal is below a certain threshold level. The other is to define a vehicle speed range, e.g. 0-15 [km/h] in which the reference signal level is known to be below a certain threshold level.

In order to evaluate the spatial freeze trigger, the spatial freeze control module 501 is employed which improves the robustness and stability of the system, e.g., in situations in which the secondary path is expected to change such as when a door or window, or the roof, sunroof or trunk is opened or closed, seats are modified, shifted or folded, and sunblinds are used. As some changes may not lead to a complete invalidation of the secondary paths and, respectively, of the estimations, in such cases the adaption process may partly continue with restrictions. The lower spectral components of an estimated secondary path may be still valid and may be used by the adaptation process. Here the spatial freeze bandwidth limit may be individually set to the last valid secondary path spectral component.

Figure 6:
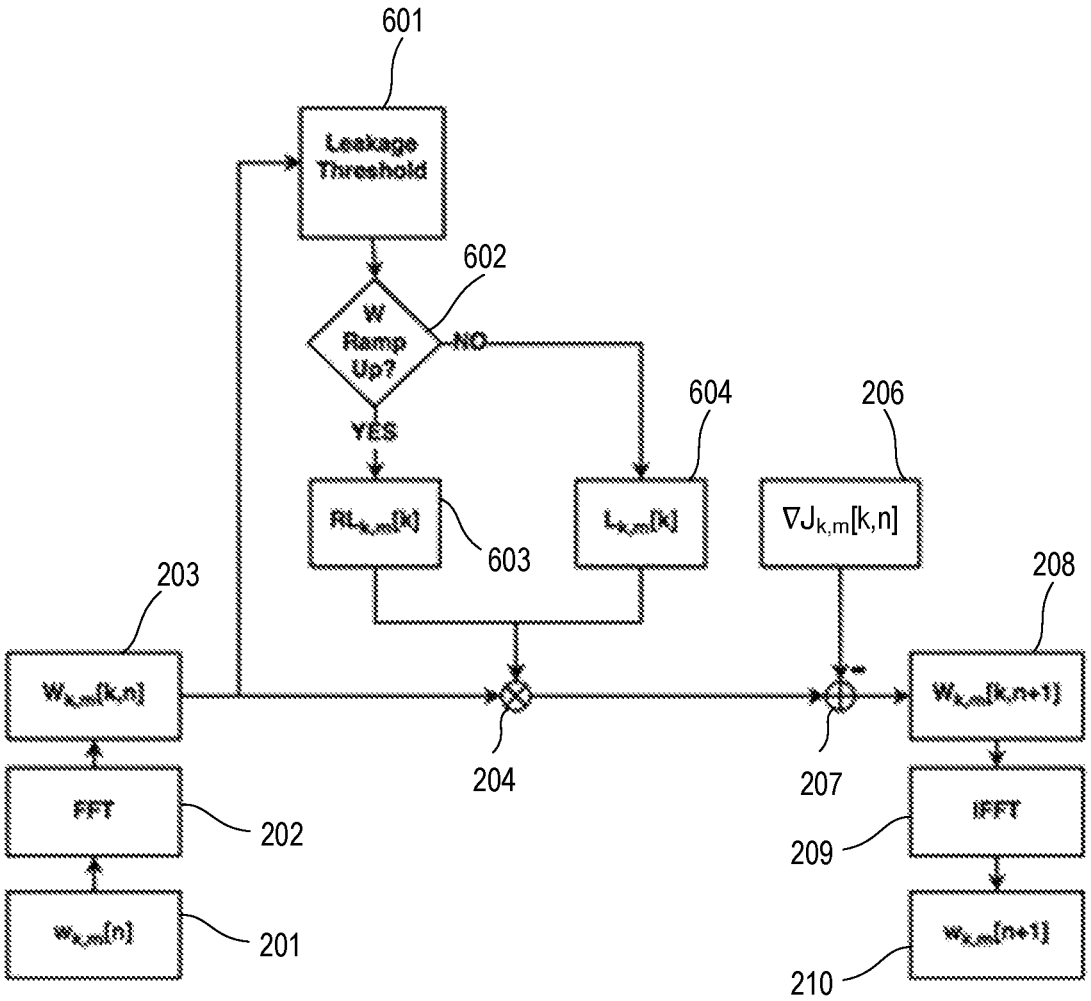
FIG. 6 is a signal flow chart illustrating a leakage threshold functionality used as an individual basic control feature for manipulating leakage in the structure shown in FIG. 2.

Referring to FIG. 6, the signal flow structure shown in FIG. 2 may be altered so that the leakage functionality 205 includes a leakage threshold functionality as a basic control feature for the w-filter update process. A leakage threshold module 601 receives data output by matrix 203 and provides a leakage threshold indication for a ramp-up detection module 602. If no ramp up of the filter coefficients w is detected by the ramp-up detection module 602, no modification is performed, therefore the leakage factor 604, which is frequency dependent, i.e., $L_{k,m}[k]$, and the update term 206, which is also frequency dependent, i.e., $\nabla J_{k,m}[k,n]$, are used. If, however, a spatial freeze request is detected by the detection module 602, the leakage factor 604 is replaced by the frequency dependent value 603, e.g., $RL_{k,m}[k]$. This means that in this example there is no influence on the update term other than by the ramp up/ramp down detection.

In leakage threshold module 601, a threshold may be defined for enabling leakage so that the w-filters could first deploy to a certain level at the beginning of an adaption or in case they have been flushed. The leakage threshold module 601 distinguishes between already adapted systems and systems in the ramp-up phase of the adaptation. It is assumed that during ramp-up, the leakage factors should be less pronounced compared to the leakage applied once the system is fully deployed:

$$w_{k,m}[n+1] = \begin{cases} IFFT\{W_{k,m}[k,n]L_{k,m}[k] - \nabla J_{k,m}[k,n]\}, & \text{if } \frac{1}{N_{Bins}}\sum_{k=1}^{N_{Bins}} \|W_{k,m}[k]\| \geq LTH_{k,m} \\ IFFT\{W_{k,m}[k,n]RL_{k,m}[k] - \nabla J_{k,m}[k,n]\}, & \text{if } \frac{1}{N_{Bins}}\sum_{k=1}^{N_{Bins}} \|W_{k,m}[k]\| < LTH_{k,m} \end{cases}$$

in which $N_{Bins}$ is the number of frequency bins, $RL_{k,m}[k]$ with k=1 . . . K and m=1 . . . M is a matrix of ramping leakage values, and $LTH_{k,m}$ with k=1 . . . K and m=1 . . . M is a matrix of leakage threshold values in the frequency domain, in which:

$$RL_{k,m}[k]=\underline{R}\text{amping}\underline{L}\text{eakage}_{k,m}[k] \text{ and}$$

$$1.0 \geq RL_{k,m}[k] \geq L_{k,m}[k].$$

Leakage freeze may be applied once the ramping leakage values equal one, which may be a valid setup for fast adaptation. For example, the ramping leakage values needs to be greater than the tuned leakage values to allow an accelerated deployment of the w-filter coefficients. Instead of a single threshold value, several threshold values ($LTH_{i,k,m}$) may be used to gradually change the applied leakage value, but the used leakage values may always comply with the following inequality, in which $N_{Threshold}$ is the number of threshold boundaries, $LTH_{i,k,m}$ with i=1 . . . $N_{Threshold}$, k=1 . . . K and m=1 . . . M is a matrix of leakage threshold values in the frequency domain, and $RL_{i,k,m}[k]$ with i=1 . . . $N_{Threshold}$, k=1 . . . K and m=1 . . . M is a matrix of leakage values, in which:

$$RL_{i,k,m}[k]=\underline{R}\text{amping}\underline{L}\text{eakage}_{i,k,m}[k] \text{ and}$$

$$1.0 \geq RL_{1,k,m}[k] \geq RL_{2,k,m}[k] \geq \ldots \geq RL_{n,k,m}[k].$$

so that $$w_{k,m}[n+1] = \begin{cases} IFFT\{W_{k,m}[k,n]RL_{n,k,m}[k] - \nabla J_{k,m}[k,n]\}, & \text{if } \frac{1}{N_{Bins}}\sum_{k=1}^{N_{Bins}} \|W_{k,m}[k,n]\| \geq LTH_{n,k,m} \\ \vdots & \vdots \\ IFFT\{W_{k,m}[k,n]RL_{2,k,m}[k] - \nabla J_{k,m}[k,n]\}, & \text{if } \frac{1}{N_{Bins}}\sum_{k=1}^{N_{Bins}} \|W_{k,m}[k,n]\| \geq LTH_{2,k,m} \\ IFFT\{W_{k,m}[k,n]RL_{1,k,m}[k] - \nabla J_{k,m}[k,n]\}, & \text{if } \frac{1}{N_{Bins}}\sum_{k=1}^{N_{Bins}} \|W_{k,m}[k,n]\| \geq LTH_{1,k,m} \end{cases}$$

Figure 7:
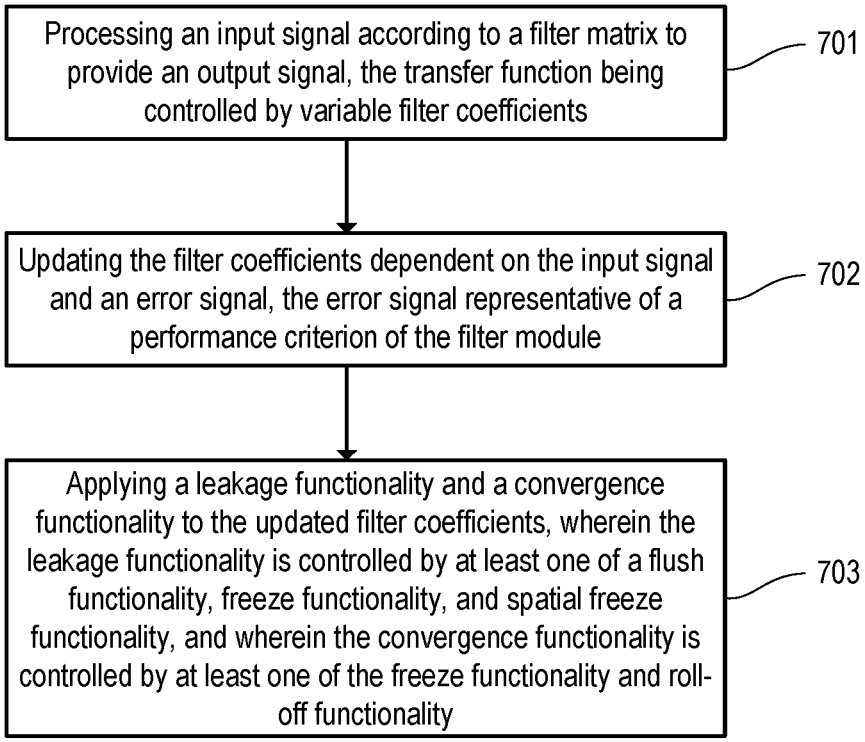
FIG. 7 is a process chart of an exemplary general active noise control filtering method.

Referring to FIG. 7, an exemplary general active noise control filtering method using an adaptive filter structure, a leakage functionality and a convergence functionality may include processing an input signal according to an adaptive and controllable w-filter matrix to provide an output signal (procedure 701), wherein the w-filter matrix is controlled by updating variable filter coefficients. The method further includes updating the filter coefficients dependent on the input signals and error signals (procedure 702), wherein the error signals are representative of a performance criterion (e.g., the cancellation performance and the like) of the filter module. The method still further includes applying a leakage functionality and a convergence functionality to the updated filter coefficients (procedure 703), wherein the leakage functionality is controlled by at least one of a flush functionality, freeze functionality, spatial freeze and leakage threshold, and the convergence functionality is controlled by the freeze functionality and spatial freeze functionality.

The flush functionality may detect the validity of the updated filter coefficients and set to a given value or ramp down the updated filter coefficients within a defined time period if the updated filter coefficients are detected to be invalid. The freeze functionality may withhold the updated filter coefficients so that the updating of the filter coefficients is disabled. The spatial freeze functionality may lower spectral parts of the filter coefficients with either a hard spectral limit or a smooth spectral transition. The leakage threshold may detect whether the active noise control filter is in an adapting or re-adapting state (e.g., after a flush process) or adapted state and adjusts the leakage functionality dependent on the detected state. The filter control module and the update control module may be operated in the frequency domain, wherein, in the frequency domain, the leakage functionality may be applied to the updated filter coefficients by multiplying a leakage factor with the updated filter coefficients and the convergence functionality may be applied to the updated filter coefficients by subtracting a convergence value from the updated filter coefficients. The at least one of flush functionality, freeze functionality and spatial freeze functionality may be controlled dependent on at least one of ambient information or the input signal. Ambient information may be, for example, information provided by a vehicle on its conditions and ambient conditions in case the method is applied in a road noise control system, an engine order control system, or any other noise control system in the vehicle.

Figure 8:
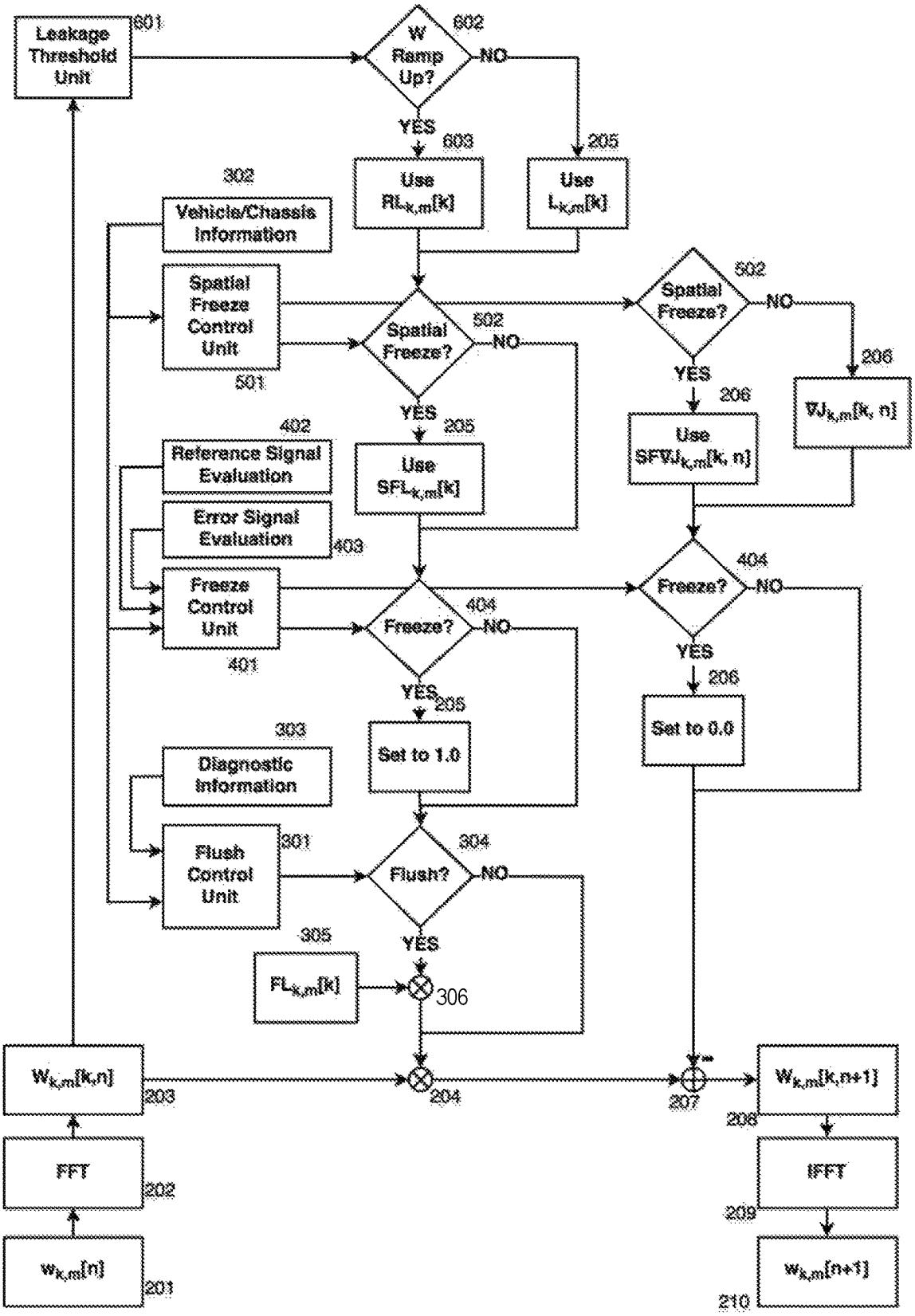
FIG. 8 is a signal flow chart illustrating an exemplary application of a multiplicity of basic control features in the structure shown in FIG. 2.

Referring to FIG. 8, the signal flow structure shown in FIG. 2 may be altered in combination with (parts of) the structures shown in FIGS. 3-6 so that an exemplary combination of all proposed freeze and flush functionalities is integrated into one signal flow structure. In the structure shown in FIG. 8, the leakage threshold unit 601 receives the signal representing the adaptation state from the non-updated (K×M) matrix 203 and provides a leakage threshold indication for the ramp-up detection module 602. If no ramp up of the filter coefficients w is detected by the ramp-up detection module 602, no modification is performed, therefore the leakage factor is $L_{k,m}[k]$. If, however, a ramp-up and, thus, a spatial freeze request is detected by the detection module 602, the leakage factor is set to $RL_{k,m}[k]$.

The spatial freeze control module 501 receives, for example, vehicle/chassis information 302. The spatial freeze control module 501 provides the spatial freeze request signal to the detection module 502. If no spatial freeze request is detected by the detection module 502, the leakage factor 205 is kept unchanged ($L_{k,m}[k]$ or $RL_{k,m}[k]$) and the update term 206 is set to $\nabla J_{k,m}[k,n]$. If, however, a spatial freeze request is detected by the detection module 502, the leakage factor 205 is set to matrix $SFL_{k,m}[k]$, k=1 . . . K and m=1 . . . M, which represents the spatial freeze leakage values in the frequency domain, and the update term 206 is set to matrix $SF\nabla J_{k,m}[k,n]$, k=1 . . . K and m=1 . . . M, which represents a frequency dependent spatial freeze update term in the frequency domain.

The freeze control module 401 receives, for example, vehicle/chassis information 302, reference signal evaluation information 402 and error signal evaluation information 403. The freeze control module 401 provides the freeze request signal to detection module 404. If no freeze request is detected by the detection module 404, the leakage factor 205 and the update term 206 are kept unchanged. If, however, a freeze request is detected by the detection module 404, the leakage factor 205 is set to 1 and the update term 206 is set to 0. The update term 206 is used for the subtraction 207.

The flush control module 301 receives, for example, vehicle/chassis information 302 and diagnostic information 303. The flush control module 301 provides a flush request signal to detection module 304. If no flush request is detected by the detection module 304, the leakage factor 205 is kept unchanged. If, however, a flush request is detected by the detection module 304, the leakage factor 205 is multiplied (e.g., by multiplier 306) with a flush leakage matrix 305, i.e., $FL_{k,m}[k]$, and the product of the two is used in the multiplication operation 204.

As can be seen, the leakage factor 205 and the update terms 206 shown in FIG. 2 are consequently altered or adjusted by checking the freeze and flush mechanism, starting with a threshold unit 601, followed by the spatial freeze unit 501, then the freeze unit 401 and ending with the flush unit 301. Depending on the adaptation state of the non-updated (K×M) matrix 203, the leakage threshold unit 601 will either use the Lk,m[k,n] or RLk,m[k,n], in order to allow a faster ramp up. The result is transferred to the spatial freeze unit 501, which uses information from the vehicle chassis 302 in order to decide whether to modify the leakage values 205, as shown in the spatial freeze unit description, by applying the SFLk,m[k] calculation or to keep the given input unchanged. Additionally the spatial freeze unit 501 decides whether the update term 206 should take the ∇Jk,m[k] values or also apply here the SF∇Jk,m[k] calculation. Accordingly, the modified or unmodified leakage and update terms are transferred to the freeze unit 401. Here, depending on the reference signal evaluation 402, the error signal evaluation 403 and the vehicle chassis information 302, the unit decides whether the leakage values 205 remain unmodified or are set to 1.0. The unit also either keeps the update term 206 unmodified or sets all values to 0.0. In the last evaluation step the freeze unit 401 transfers the modified or unmodified leakage values 205 to the flush unit 301. The flush unit 301 judges, based on diagnostic information 303, whether the leakage values 205 are to be modified by FLk,m[k] 305 or not in order to perform either no, a slow or a fast matrix filter fade out, as the mechanism is shown doing in the flush functionality section. Here the leakage values 205 have to pass all related check-points, "W Ramp Up?" 602, "Spatial Freeze?" 502, "Freeze?" 404 and "Flush?" 304. Also the update term 206 has to pass its related check points, "Spatial Freeze?" 502 and "Freeze?" 304. Once the leakage values 205 and the update term 206 have passed all check points, the filter matrix iterative update can be applied and Wk,m[k,n+1] 208 can be calculated and transformed by the IFFT unit 209 to the next FIR filter wk,m[n] 210 into the time domain.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. An active noise control filter arrangement with an adaptive filter structure, the arrangement comprising:

a controllable filter module configured to process according to a controllable filter matrix with at least one input signal to provide at least one output signal, the filter matrix having variable filter coefficients and being controlled by updating the filter coefficients;

a filter control module configured to update the filter coefficients dependent on the at least one input signal and at least one error signal, the at least one error signal being representative of at least one performance criterion of the controllable filter module; and an update control module configured to apply a leakage functionality and a convergence functionality to the updated filter coefficients, wherein at least one of: the leakage functionality is controlled by at least one of a flush functionality, a freeze functionality, a spatial freeze functionality and a leakage threshold functionality, and the convergence functionality is controlled by at least one of the freeze functionality and the spatial freeze functionality, wherein the filter control module and the update control module are operated in a frequency domain; and, in the frequency domain, the leakage functionality is applied to the updated filter coefficients by multiplying a leakage factor with the updated filter coefficients and the convergence functionality is applied to the updated filter coefficients by subtracting a convergence value from the updated filter coefficients.

2. The arrangement of claim 1, wherein the flush functionality is configured to flush or ramp down to a certain value the updated filter coefficients if the updated filter coefficients are detected to be invalid due to a permanent change of characteristics of a primary acoustic path, erroneous detected system components, or rapid road impact changes.

3. The arrangement of claim 1, wherein the freeze functionality is configured to hold the updated filter coefficients so that updating of the filter coefficients is disabled if the updated filter coefficients are detected to be invalid due to at least one of an instability and performance loss of the controllable filter module.

4. The arrangement of claim 1, wherein the spatial freeze functionality is controlled by a spatial freeze control functionality, the spatial freeze control functionality being configured to change adaptation of the filter coefficients to temporarily reduce a bandwidth of the leakage functionality and the convergence functionality if the updated filter coefficients are detected to be invalid due to a change of characteristics of a secondary acoustic path.

5. The arrangement of claim 1, wherein the freeze functionality comprises a ramp-up detection that is controlled by a leakage threshold functionality, the leakage threshold functionality being configured to detect whether the active noise control filter arrangement is in an adapting state or adapted state and to adjust the leakage functionality dependent on the detected state.

6. The arrangement of claim 1, wherein at least one of flush functionality, freeze functionality and spatial freeze functionality is controlled dependent on at least one of ambient information, the at least one input signal, reference signal information, and the at least one error signal.

7. An active noise control filtering method using an adaptive filter structure, the method comprising:

processing according to a controllable filter matrix with at least one input signal to provide at least one output signal, the filter matrix having variable filter coefficients and being controlled by updating the filter coefficients;

updating the filter coefficients dependent on the at least one input signal and at least one error signal, the at least one error signal being representative of at least one performance criterion of a controllable filter module;

applying a leakage functionality and a convergence functionality to the updated filter coefficients, wherein at least one of:

the leakage functionality is controlled by at least one of a flush functionality, a freeze functionality, a spatial freeze functionality and a leakage threshold functionality, and the convergence functionality is controlled by at least one of the freeze functionality and the spatial freeze functionality; and operating a filter control module and an update control module in a frequency domain; and, in the frequency domain, the leakage functionality is applied to the updated filter coefficients by multiplying a leakage factor with the updated filter coefficients and the convergence functionality is applied to the updated filter coefficients by subtracting a convergence value from the updated filter coefficients.

8. The method of claim 7, wherein the flush functionality is configured to flush or ramp down to a certain value updated filter coefficients if the updated filter coefficients are detected to be invalid due to a permanent change of characteristics of a primary acoustic path, erroneous detected system components, or rapid road impact changes.

9. The method of claim 7, wherein the freeze functionality is configured to hold the updated filter coefficients so that updating of the filter coefficients is disabled if the updated filter coefficients are detected to be invalid due to an instability and/or performance loss of an adapted filter module.

10. The method of claim 7, wherein the spatial freeze functionality is controlled by a spatial freeze control functionality, the spatial freeze control functionality being configured to change adaptation of the filter coefficients to temporarily reduce a bandwidth of the leakage functionality and the convergence functionality if the updated filter coefficients are detected to be invalid due to a change of characteristics of a secondary acoustic path.

11. The method of claim 7, wherein the freeze functionality comprises a ramp-up detection that is controlled by a leakage threshold functionality, the leakage threshold functionality being configured to detect whether the active noise control filtering method is in an adapting state or adapted state and to adjust the leakage functionality dependent on the detected state.

12. The method of claim 7, wherein at least one of the flush functionality, the freeze functionality and the spatial freeze functionality is controlled dependent on at least one of ambient information, a control filtering state, reference signal information and the at least one error signal.

13. An active noise control filter arrangement with an adaptive filter structure, the arrangement comprising:

a controllable filter module configured to process according to a controllable filter matrix with at least one input signal to provide at least one output signal, the filter matrix having variable filter coefficients and being controlled by updating the filter coefficients;

a filter control module configured to update the filter coefficients dependent on the at least one input signal and at least one error signal, the at least one error signal being representative of at least one performance criterion of the controllable filter module; and an update control module configured to apply a leakage functionality and a convergence functionality to the updated filter coefficients, wherein at least one of: the leakage functionality is controlled by at least one of a flush functionality, a freeze functionality, a spatial freeze functionality and a leakage threshold functionality, and the convergence functionality is controlled by at least one of the freeze functionality and the spatial freeze functionality, wherein the filter control module and the update control module are operated in a frequency domain; and, in the frequency domain, the leakage functionality is applied to the updated filter coefficients by multiplying a leakage factor with the updated filter coefficients and the convergence functionality is applied to the updated filter coefficients by subtracting a convergence value from the updated filter coefficients.

14. The arrangement of claim 13, wherein the flush functionality is configured to flush or ramp down to a certain value the updated filter coefficients if the updated filter coefficients are detected to be invalid due to a permanent change of characteristics of a primary acoustic path, erroneous detected system components, or rapid road impact changes.

15. The arrangement of claim 13, wherein the freeze functionality is configured to hold the updated filter coefficients so that updating of the filter coefficients is disabled if the updated filter coefficients are detected to be invalid due to at least one of an instability and performance loss of the controllable filter module.

16. The arrangement of claim 13, wherein the spatial freeze functionality is controlled by a spatial freeze control functionality, the spatial freeze control functionality being configured to change adaptation of the filter coefficients to temporarily reduce a bandwidth of the leakage functionality and the convergence functionality if the updated filter coefficients are detected to be invalid due to a change of characteristics of a secondary acoustic path.

17. The arrangement of claim 13, wherein the freeze functionality comprises a ramp-up detection that is controlled by a leakage threshold functionality, the leakage threshold functionality being configured to detect whether the active noise control filter arrangement is in an adapting state or adapted state and to adjust the leakage functionality dependent on the detected state.

* * * * *